US008443745B2

(12) United States Patent
Asao et al.

(10) Patent No.: US 8,443,745 B2
(45) Date of Patent: May 21, 2013

(54) SEAM, SEAM FORMING DEVICE, AND SEAM FORMING METHOD

(75) Inventors: Hideo Asao, Chofu (JP); Nobuhiro Nishi, Chofu (JP)

(73) Assignee: Hougi Corporation, Shibuya-Ku, Tokyo (JP)

( * ) Notice: Subject to any disclaimer, the term of this patent is extended or adjusted under 35 U.S.C. 154(b) by 260 days.

(21) Appl. No.: 12/738,786

(22) PCT Filed: Nov. 6, 2008

(86) PCT No.: PCT/JP2008/070227

§ 371 (c)(1),
(2), (4) Date: Apr. 19, 2010

(87) PCT Pub. No.: WO2009/063795

PCT Pub. Date: May 22, 2009

(65) Prior Publication Data

US 2010/0212070 A1 Aug. 26, 2010

(30) Foreign Application Priority Data

Nov. 14, 2007 (JP) ..... 2007-296142

(51) Int. Cl.
*D05B 1/08* (2006.01)

(52) U.S. Cl.
USPC ..... 112/438; 112/197; 112/475.17

(58) Field of Classification Search
USPC ..... 112/197–202, 438, 440, 475.17
See application file for complete search history.

(56) References Cited

U.S. PATENT DOCUMENTS 3,776,157 A * 12/1973 Szostak ..... 112/162
3,908,569 A 9/1975 Ketterer
4,175,499 A * 11/1979 Navlyt ..... 112/165

(Continued)

FOREIGN PATENT DOCUMENTS

JP 46-014222 B1 4/1971
JP 48-072055 U 9/1973

(Continued)

OTHER PUBLICATIONS

International Search Report (PCT/ISA/210) for PCT/JP2008/070227 dated Dec. 2, 2008.

*Primary Examiner* — Danny Worrell
(74) *Attorney, Agent, or Firm* — Buchanan Ingersoll & Rooney PC

(57) ABSTRACT

To provide a seam of attractive appearance in which tightening force is increased and raveling are prevented drastically. A seam (1) is formed by two needles (11, 12) juxtaposed in the direction at substantially right angles to the sewing direction (T), and consists of a chain seam (10) formed by a needle thread (12) passed through one needle (11), and a lock seam (20) formed by a needle thread (22) passed through the other needle (21). The loop (13) of a needle thread forming the chain seam (10) is passed through the loop (23) of a needle thread forming the lock seam (20) before tightening of stitch is performed, and a loop of the needle thread forming the chain seam located on a downstream side in the sewing direction is passed through the loop of the needle thread forming the upstream chain seam.

6 Claims, 14 Drawing Sheets

U.S. PATENT DOCUMENTS

| | | | | | |
|---|---|---|---|---|---|
| 4,194,456 | A | | 3/1980 | Edwards et al. | |
| 4,356,782 | A | * | 11/1982 | Ueyama et al. | 112/197 |
| 4,512,274 | A | * | 4/1985 | Campbell et al. | 112/423 |
| 4,580,514 | A | * | 4/1986 | Hanyu et al. | 112/162 |
| 4,875,423 | A | * | 10/1989 | Conti | 112/438 |
| 4,917,032 | A | * | 4/1990 | Matsumoto | 112/475.04 |
| 5,383,414 | A | * | 1/1995 | Winter et al. | 112/162 |
| 5,544,604 | A | * | 8/1996 | Winter | 112/475.17 |
| 6,098,555 | A | * | 8/2000 | Sakuma | 112/165 |

FOREIGN PATENT DOCUMENTS

| | | | |
|---|---|---|---|
| JP | 48-072055 | U1 | 9/1973 |
| JP | 51-066057 | A | 6/1976 |
| JP | 54-161447 | A | 12/1979 |
| JP | 55-156668 | U | 11/1980 |
| JP | 58-022697 | Y2 | 5/1983 |
| JP | 3673901 | B2 | 7/2005 |

* cited by examiner

SEAM, SEAM FORMING DEVICE, AND SEAM FORMING METHOD

TECHNICAL FIELD

The present invention relates to a seam formed by needle threads of two needles, less likely to be slackened and raveled, and having a novel structure and to a device and a method for forming the seam.

BACKGROUND ART

Conventionally, as shown in FIGS. 14(*a*) and 14(*b*), there is a seam A consisted of chain seams a1 and lock seams a2 disposed on the same straight line along a sewing direction T. The seam A is formed by sewing with two needles arranged in a line along the sewing direction T. The chain seams a1 are formed by a needle thread of the needle located on an upstream side in the sewing direction T. The lock seams a2 are formed by a needle thread of the needle located on a downstream side in the sewing direction T (e.g., Patent Document 1).

Patent Document 1: Japanese Patent No. 3673601

DISCLOSURE OF THE INVENTION

Problems to be Solved by the Invention

The conventional seam A has the chain seams a1 and the lock seams a2 on the same straight line. Therefore, the needle forming the chain seams a1 and the needle forming the lock seams a2 are disposed on the same straight line along the sewing direction T. A pitch width P1 of the needle forming the chain seam a1 needs to be longer than an interval P2 between the needle for forming the chain seams a1 and the needle for forming the lock seams a2 so as to form the seam A. Therefore, the seam A needs to be set in consideration of a positional relationship between the needle for forming the chain seams a1 and the needle for forming the lock seams a2, which takes a lot of trouble. Moreover, in the conventional seam A, the lock seam a2 merely pulls the chain seam a1 to a front face side (upward) of a sewing material for tightening and therefore tightening force and resisting force for preventing slackening and raveling are slightly weak.

The invention of the present application has been made in view of the above problems and it is a first object of the invention to provide a seam without trouble of considering a positional relationship between a needle for forming chain seams and a needle for forming lock seams and with increased tightening force and resisting force for drastically preventing slackening and raveling. It is a second object to provide a seam forming device for forming the seam. It is a third object to provide a seam forming method for forming the seam.

Means for Solving the Problems

To achieve the first object, a seam according to a first aspect of the present application is a seam formed by two needles juxtaposed in a substantially perpendicular direction to a sewing direction. The seam includes chain seams and lock seams formed by needle threads respectively passed through the two needles. A loop of the needle thread forming the chain seam is passed through a loop of the needle thread forming the lock seam, a stitch is tightened, and a loop of the needle thread forming the chain seam located on a downstream side in the sewing direction is passed through the loop of the needle thread forming the upstream chain seam.

To achieve the first object, a seam according to a second aspect of the present application is a seam formed by two needles juxtaposed in a substantially perpendicular direction to a sewing direction. The seam includes chain seams and lock seams formed by needle threads respectively passed through the two needles. A loop of the needle thread forming the chain seam is passed through a loop of the needle thread forming the lock seam, a stitch is tightened, and a loop of the needle thread forming the lock seam located on a downstream side in the sewing direction is passed through the loop of the needle thread forming the upstream chain seam.

To achieve the first object, a seam according to a third aspect of the present application is a seam formed by two needles juxtaposed in a substantially perpendicular direction to a sewing direction. The seam includes chain seams and lock seams formed by needle threads respectively passed through the two needles. A loop of the needle thread forming the chain seam is passed through a loop of the needle thread forming the lock seam, a stitch is tightened, and a loop of the needle thread forming the chain seam and a loop of the needle thread forming the lock seam located on a downstream side in the sewing direction are passed through the loop of the needle thread forming the upstream chain seam.

To achieve the first object, a seam according to a fourth aspect of the present application is a seam formed by alternately forming chain seams and lock seams by two needles juxtaposed in a substantially perpendicular direction to a sewing direction. The seam includes a first seam and a second seam. A loop of the needle thread forming the chain seam of the first seam is passed through a loop of the needle thread forming the opposed lock seam of the second seam, a stitch is tightened, a loop of the needle thread forming the chain seam of the second seam located on a downstream side in the sewing direction is passed through the loop of the needle thread forming the upstream chain seam of the first seam. A loop of the needle thread forming the chain seam of the second seam is passed through a loop of the needle thread forming the opposed lock seam of the first seam, a stitch is tightened, and a loop of the needle thread forming the chain seam of the first seam located on a downstream side in the sewing direction is passed through the loop of the needle thread forming the upstream chain seam of the second seam.

To achieve the second object, a seam forming device according to a fifth aspect of the present application includes: two needles which are juxtaposed in a substantially perpendicular direction to a sewing direction and to which needle threads for forming chain seams and lock seams are fed; an upper drive means for reciprocating the two needles in a vertical direction; a first looper for passing a loop of the needle thread of one of the needles formed on a back face side of a sewing material through a loop of the needle thread of the other needle in synchronization with vertical movements of the two needles; a loop spreader for retaining the loop of the needle thread of the one needle formed by the first looper until the needle thread of the one needle of the next or later stitch is positioned in the loop of the needle thread of the one needle of the earlier stitch; a second looper for passing the loop of the needle thread of the one needle of the next or later stitch through the loop of the one needle thread retained by the loop spreader; and a lower drive means for causing the first and second loopers and the loop spreader to operate in synchronization with the vertical movements of the two needles. The device forms a seam formed by tightening the chain seam by the lock seam.

To achieve the third object, a seam forming method according to a sixth aspect of the present application is a seam forming method for sewing by forming chain seams and lock seams with needle threads of two needles juxtaposed in a substantially perpendicular direction to a sewing direction. The method includes: a first step of moving down the two needles by a drive means to protrude the needle thread of one needle and the needle thread of the other needle to a back face side of a sewing material; a second step of moving up the two needles by the drive means to form a loop of the needle thread of the one needle and a loop of the needle thread of the other needle on the back face side of the sewing material and passing the loop of the needle thread of the one needle formed on the back face side of the sewing material through the loop of the needle thread of the other needle by a first looper protruding in synchronization with the upward movements of the two needles; a third step of retaining the loop of the needle thread of the one needle, which is retained by the first looper during the upward movements of the two needles, on a loop spreader protruding in synchronization with the upward movements of the two needles and then for returning the first looper to an original position to separate the first looper from the one needle thread; and a fourth step of spreading the loop of the one needle thread, which is retained on the loop spreader, by a second looper protruding in synchronization with the first looper, passing the one needle out of the two lowering needles through the spread loop of the one needle thread, and returning the second looper and the loop spreader to original positions to separate the second looper and the loop spreader from the one needle thread.

Effects of the Invention

The seam according to the invention of the present application is formed by forming the chain seams and the lock seams by the two needles juxtaposed in the substantially perpendicular direction to the sewing direction. Therefore, unlike the conventional seam, the seam can be formed without the trouble of setting the positional relationship between the needle for forming the chain seams and the needle for forming the lock seams in consideration of a feeding pitch width of the needle for forming the chain seams and an interval between the needle for forming the chain seams and the needle for forming the lock seams.

In the seam according to the invention of the present application, the chain seams and the lock seams are not disposed on the same straight line as in the conventional seam but disposed with the predetermined interval therebetween and the loop of the needle thread forming the lock seam pulls and tightens the loop of the needle thread forming the chain seam to the front face side (upward) of the sewing material after pulling the loop aside (toward the lock seam). Therefore, the tightening force and the resisting force are increased, the slackening and raveling are prevented drastically, and tightening of the stitch is performed reliably.

According to seam forming device and forming method according to the invention of the present application, it is possible to efficiently and easily form the seam having the above effects.

BEST MODE FOR CARRYING OUT THE INVENTION

Figure 1:
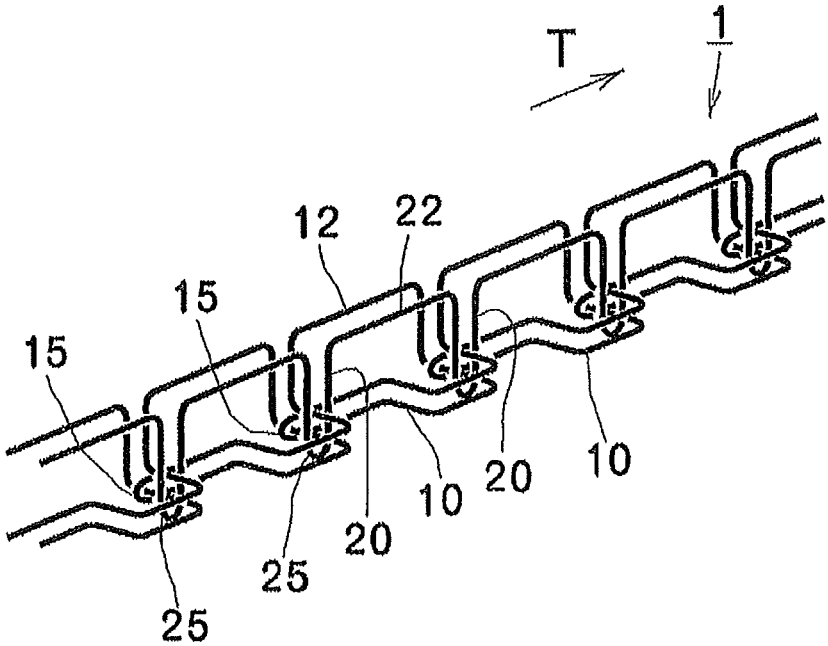
FIG. 1 is a perspective view showing an embodiment of a seam according to the invention of the present application.
Figure 2:
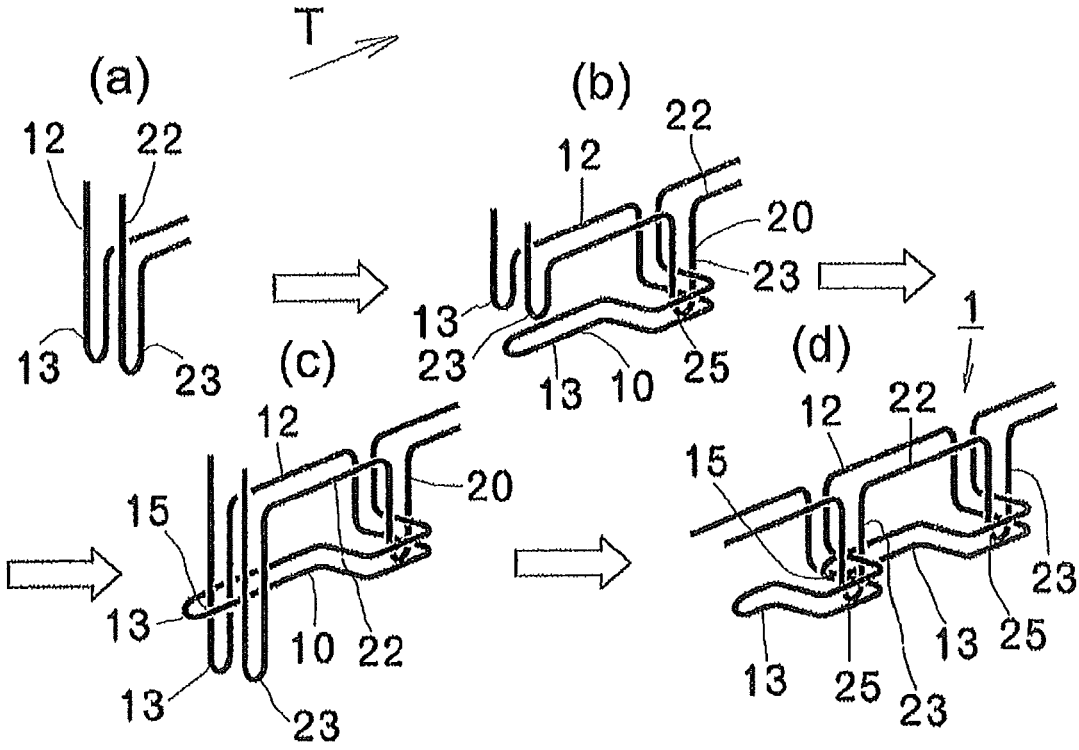
FIGS. 2(*a*) to 2(*d*) are perspective views showing a forming process of the seam in FIG. 1.
Figure 3:
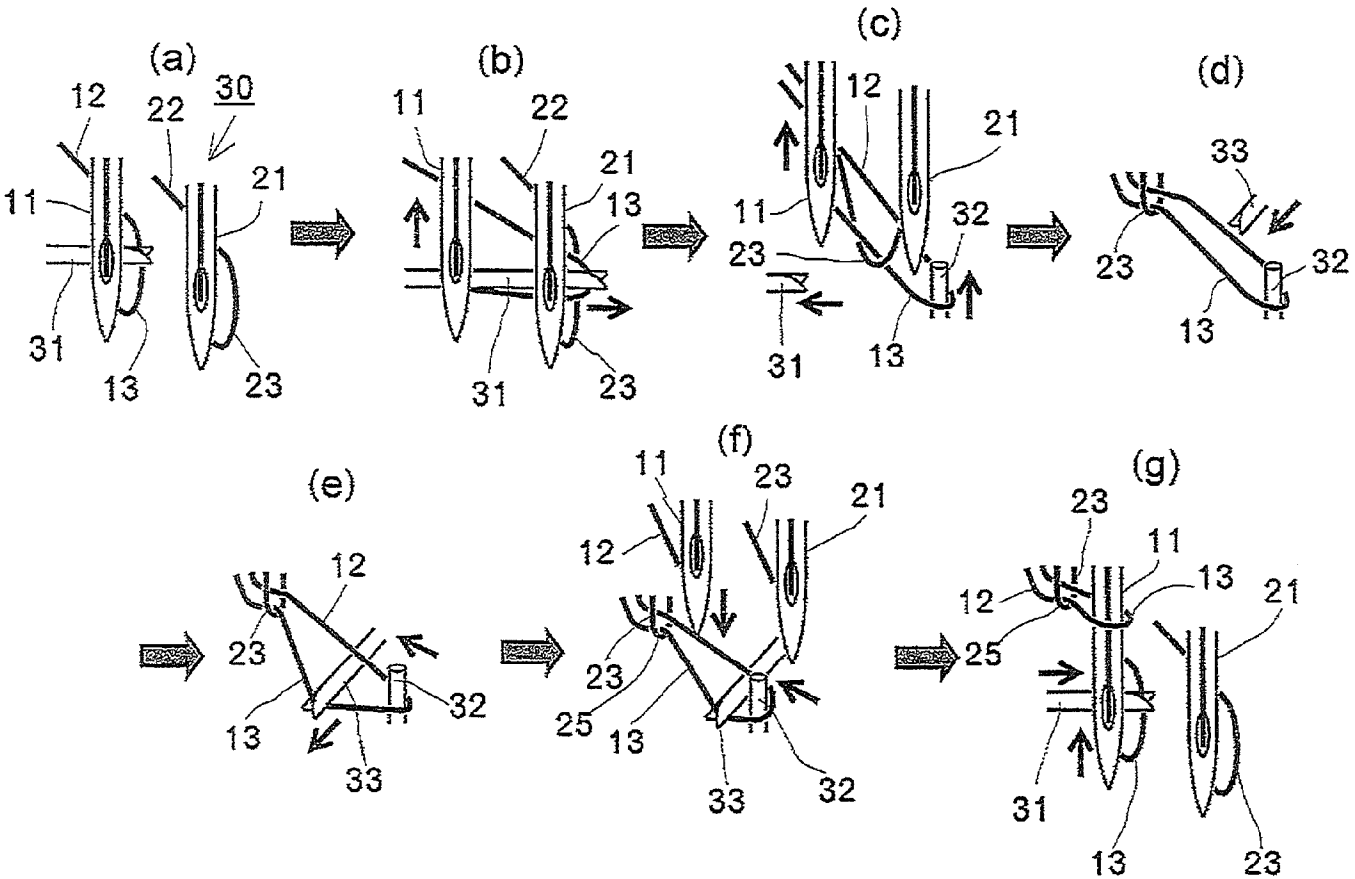
FIGS. 3(*a*) to 3(*g*) are explanatory views showing forming steps of the seam in FIG. 1.
Figure 4:
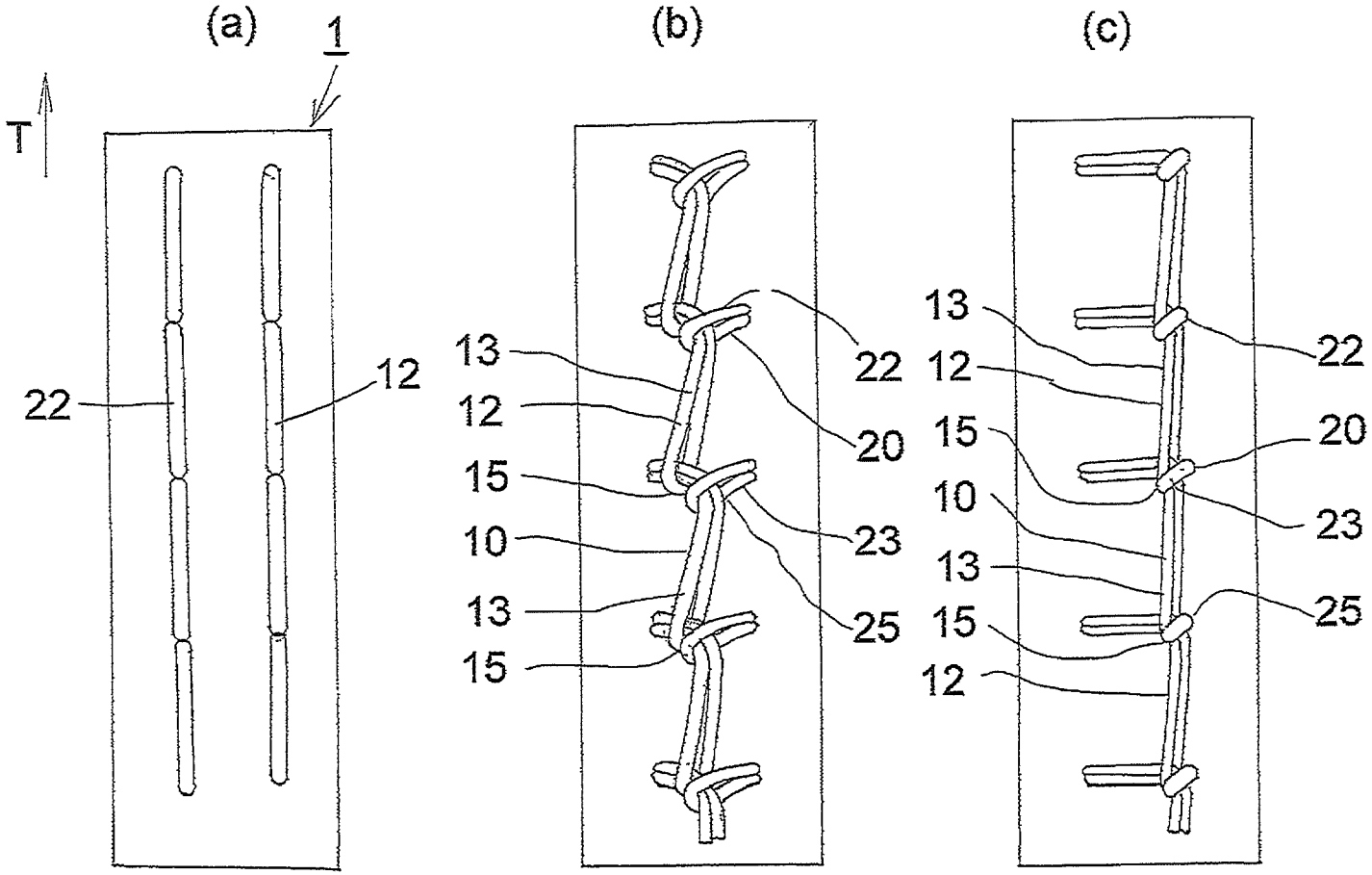
FIGS. 4(*a*) to 4(*c*) are explanatory views showing amounted state of the seam in FIG. 1 on a sewn article.

A first embodiment of a seam according to the invention of the present application will be described based on FIGS. 1 to 4(*c*). FIG. 1 is a perspective view of the seam according to the invention of the present application. FIGS. 2(*a*) to 2(*d*) are perspective views showing a forming process of the seam in FIG. 1. FIGS. 3(*a*) to 3(*g*) are explanatory views showing forming steps of the seam in FIG. 1. FIGS. 4(*a*) to 4(*c*) are explanatory views showing a mounted state of the seam in FIG. 1 on a sewing material, wherein FIG. 4(*a*) is a plan view from a front face side, FIG. 4(*b*) is a plan view from a back face side and showing a midpoint step, and FIG. 4(*c*) is a plan view from a back face side and showing a final step.

As shown in FIG. 1, the seam 1 consists of chain seams 10 and lock seams 20. The seam 1 is formed by two needles 11 and 21 juxtaposed in a substantially perpendicular direction to a sewing direction (a direction T in FIG. 1). As shown in FIGS. 3(*a*) to 3(*g*), the chain seams 10 are formed by a needle thread 12 passed through one needle 11 out of the two needles. The lock seams 20 are formed by a needle thread 22 passed through the other needle 21 out of the two needles. As shown in FIGS. 2(*b*) and 2(*c*), a loop 13 of the needle thread 12 forming the chain seam 10 is passed through a loop 23 of the needle thread 22 forming the lock seam 20, a stitch is tightened, and a loop 13 of the needle thread 12 forming a chain seam 10 located on a downstream side in the sewing direction T is passed through the upstream loop 13.

As shown in FIG. 4(*a*), the needle thread 12 forming the chain seams 10 and the needle thread 22 forming the lock seams 20 extend substantially parallel with a predetermined interval therebetween on a front face side of cloths as sewing material. As shown in FIG. 4(*b*), on the back face side, the chain seams 10 are formed by forming the loop 13 for each stitch of the needle 11 and passing the downstream loop 13 through the upstream loop 13 to form a knot portion 15 (see FIG. 2(*c*)). On the back face side, the lock seams 20 are formed by forming the loop 23 for each stitch of the needle 21 and passing a portion of the loop 13, which is formed by the adjacent needle 11, on a downstream side of the knot portion 15 through the loop 23 to form a tightening portion 25 to tighten the chain seam 10 (see FIG. 2(*d*)).

The seam 1 is formed by forming the chain seam 10 by the one needle thread 12 and forming the lock seam 20 by the other needle thread 22 simultaneously and tightening, with a tightening portion 25 of the lock seam 20, the portion of the chain seam 10 on the downstream side of the knot portion 15 in the sewing direction shown by an arrow T in FIG. 1 to tighten the stitch. Accordingly, it is possible to reliably eliminate ease of raveling of the chain seam 10.

Moreover, the seam 1 includes two threads for pressing and joining the cloths on each of the front face and the back face of the cloths. Therefore, it is possible to overcome weakness after sewing, which is a drawback of the chain seam 10, while maintaining a stretch property due to the chain seam 10 and it is possible to obtain a sewn state of high quality such as soft texture. Moreover, because the seam 1 is formed by using the two needle threads 12 and 22, the respective needle threads 12 and 22 can be fed from spools (not shown) around which large quantities of thread are wound and it is possible to efficiently carry out sewing operation for a long time. Furthermore, the seam 1 has separate thread paths for the two needle threads 12 and 22 and therefore it is possible to reliably prevent stitch skipping to maintain high sewing quality.

As shown in FIG. 3, a seam forming device 30 for forming the seam 1 includes the two needles 11 and 21 juxtaposed in the substantially perpendicular direction to the sewing direction (the direction of the arrow T in FIG. 1) with an interval therebetween. The seam forming device 30 is mounted on a known sewing machine (not shown), especially an industrial sewing machine, and respective mechanisms such as a cloth feeding mechanism and a thread take-up lever mechanism will not be described.

The two needles 11 and 21 are attached to needle bars by needle clamps, the needle bars being allowed to reciprocate with a predetermined vertical stroke by a known upper drive means (not shown) called a needle bar drive mechanism or the like operating in synchronization with an upper shaft driven for rotation by a sewing machine motor as a drive source. Therefore, the two needles 11 and 21 are caused to reciprocate in a vertical direction by the upper drive means. The upper drive means will not be described in detail.

As shown in FIGS. 3(*a*) and 3(*b*), the seam forming device 30 includes a first looper 31 for passing the loop 13 of the needle thread 12 of the one needle 11 formed on the cloth back in synchronization with vertical movements of the two needles 11 and 21 through the loop 23 of the needle thread 22 of the other needle 21. As shown in FIGS. 3(*c*) and 3(*d*), the seam forming device 30 includes a loop spreader 32 for retaining the loop 13 of the needle thread 12 of the one needle 11 formed by the first looper 31 until the needle thread 12 of the one needle 11 for the next or later stitch is positioned in the loop 13. As shown in FIGS. 3(*e*) and 3(*f*), the seam forming device 30 includes a second looper 33 for passing the next loop 13 of the needle thread 12 of the on needle 11 through the loop 13 of the one needle thread 12 retained around the loop spreader 32. Moreover, the seam forming device 30 is provided with a lower drive means (not shown) for causing the first looper 31, the second looper 33, and the loop spreader 32 to operate in synchronization with the vertical movements of the two needles 11 and 21.

The one needle 11 positioned on the left side of the sewing direction shown by the arrow T in FIG. 2 out of the two needles 11 and 21 is for forming the chain seams 10 and the needle thread 12 for forming the chain seams 10 is fed to the needle 11. The other needle 21 positioned on the right side of the sewing direction shown by the arrow T in FIG. 2 is for forming the lock seams 20 and the needle thread 22 for forming the lock seams 20 is fed to the needle 21. As shown in FIG. 3(*a*), to pass the loop 13 of the needle thread 12 of the one needle 11 through the loop 23 of the needle thread 22 of the other needle 21, the other needle 21 is set to be longer than the one needle 11.

The seam forming device 30 operates as follows to form the seam 1. If the seam forming device 30 is turned on and switched on (not shown), the upper drive means and the lower drive means interlocked with the upper drive means are actuated, the two needles 11 and 21 perform the vertical reciprocation, and the first looper 31, the loop spreader 32, and the second looper 33 perform predetermined movements.

As shown in FIG. 3(*a*), when the two needles 11 and 21 move down to protrude the needle thread 12 of the one needle 11 and the needle thread 22 of the other needle 21 to the back face side of the cloth that is the sewing material and the two needles 11 and 21 move up, the loop 13 of the needle thread 12 of the one needle 11 and the loop 23 of the needle thread 22 of the other needle 21 are formed on the back face side of the cloth (see FIG. 2(*a*)). Then, as shown in FIG. 3(*b*), the first looper 31 protrudes and passes the loop 13 of the needle thread 12 of the one needle 11, which is formed on the back face side of the cloth by the first looper 31, through the loop 23 of the needle thread 22 of the other needle 21.

As shown in FIG. 3(*c*), after the loop 13 of the needle thread 12 of the one needle 11 retained by the first looper 31 during upward movements of the two needles 11 and 21 is retained around the loop spreader 32 protruding in synchronization with the upward movements of the two needles 11 and 21, the first looper 31 is returned to an original position and separated from the one needle thread 12. As shown in FIG. 3(*d*), the second looper 33 protrudes in synchronization with the first looper 31.

As shown in FIG. 3(*e*), while the second looper 33 spreads the loop 13 of the one needle thread 12 retained around the loop spreader 32, the loop spreader 32 kept in the protruding state moves toward the one needle 11 side to prevent the other needle 21 from entering the spread loop 13 (see FIG. 2(*b*)). As shown in FIG. 3(*f*), the two needles 11 and 21 move down, the one needle 11 is passed through the spread loop 13 of the one needle thread 12, the loop spreader 32 and the second looper 33 return to original positions and separate from the one needle thread 12 (see FIG. 2(*c*)).

As shown in FIG. 3(*g*), the loop 13 of the needle thread 12 is looped over the needle 11. As shown in FIG. 3(*g*), if the two needles 11 and 21 move up, the device comes into the same state as that in FIG. 3(*a*), the loop 13 of the needle thread 12 of the one needle 11 and the loop 23 of the needle thread 22 of the other needle 21 are formed on the back face side of the cloth, and the above steps are repeated. In this manner, the seam forming device 30 forms the seam 1 shown in FIG. 2(*d*).

In the seam 1, the chain seams 10 and the lock seams 20 are not disposed on the same straight line but disposed substantially parallel with a predetermined interval therebetween. The loop 13 of the needle thread 12 forming the chain seam 10 is passed through the loop 23 of the needle thread 22 forming the lock seam 20 to form the tightening portion 25 and the loop 13 of the needle thread 12 forming the chain seam 10 is pulled toward the lock seam 20 side and tightened by the tightening portion 25. Therefore, the tightening force is increased and the slackening and raveling are prevented drastically.

Figure 5:
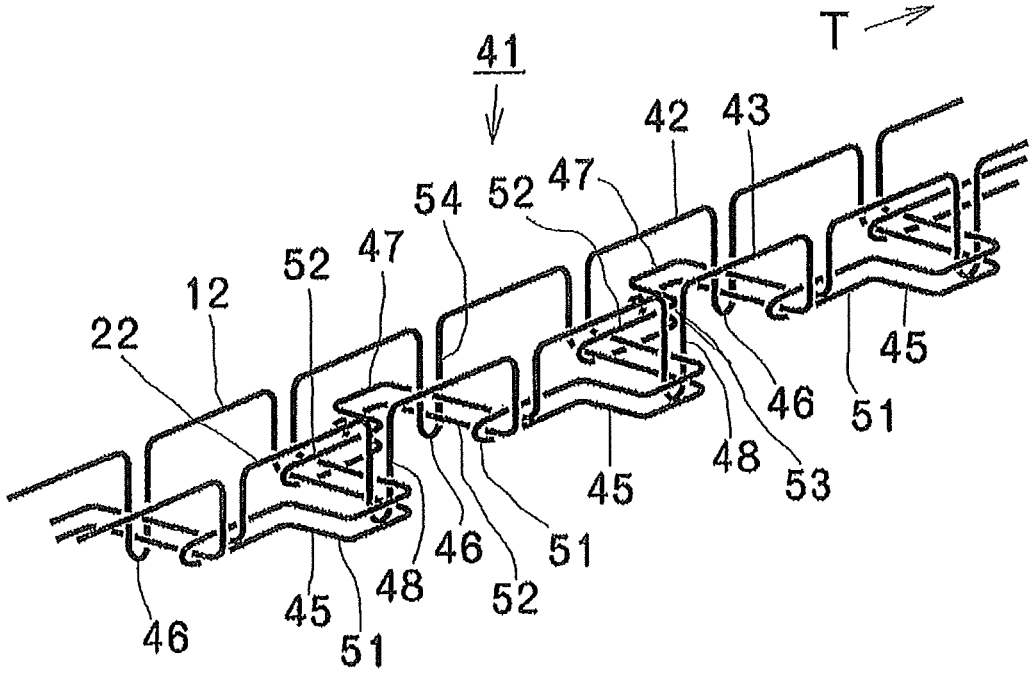
FIG. 5 is a perspective view showing another embodiment of the seam according to the invention of the present application.
Figure 6:
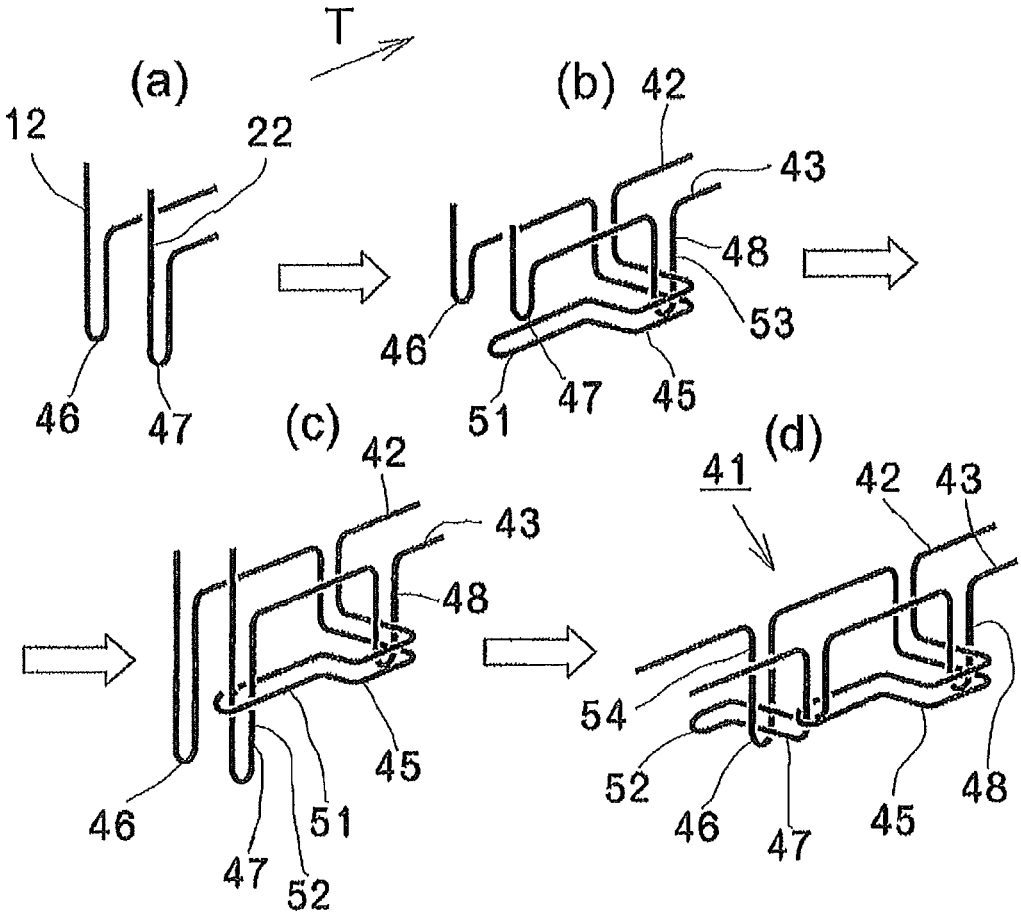
FIGS. 6(*a*) to 6(*d*) are perspective views showing a forming process of the seam in FIG. 5.
Figure 7:
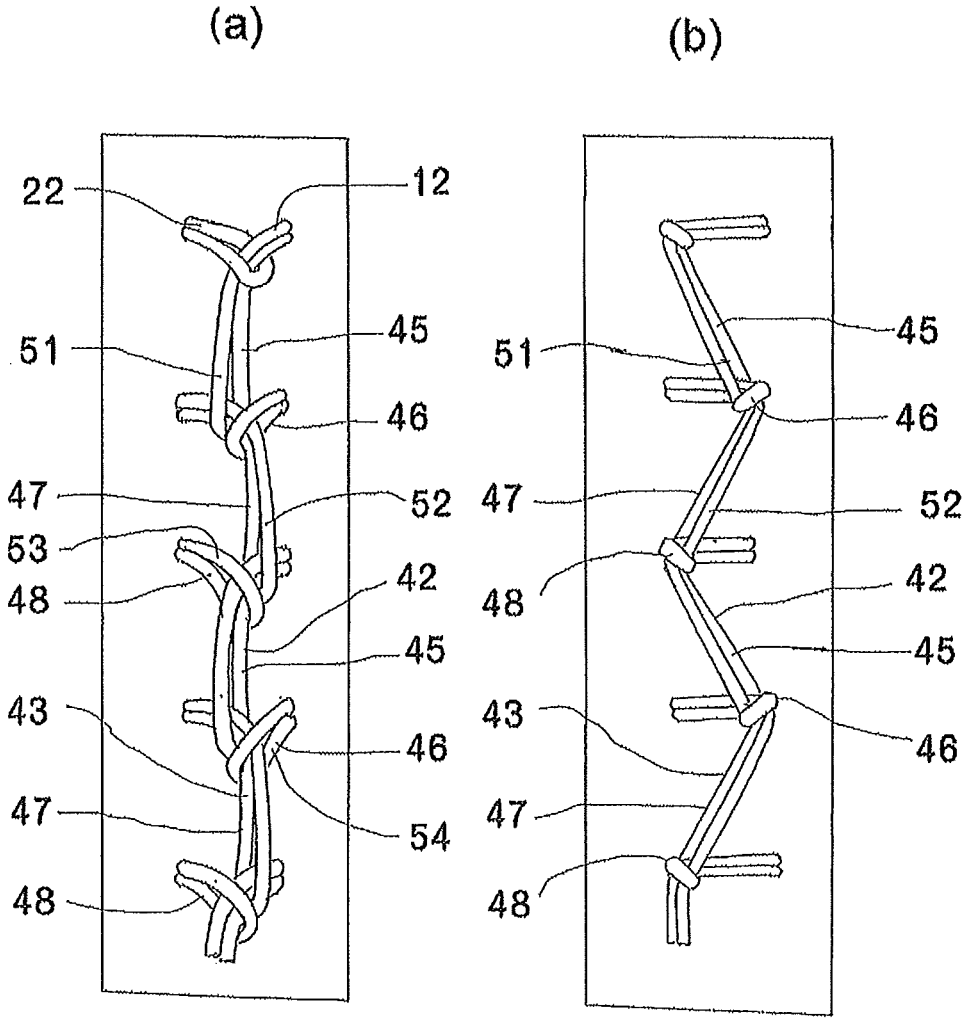
FIGS. 7(*a*) and 7(*b*) are explanatory views showing a mounted state of the seam in FIG. 5 on a sewing material.

A second embodiment of the seam according to the invention of the present application will be described based on FIGS. 5 to 7(*b*). FIG. 5 is a perspective view of the seam according to the invention of the present application. FIGS. 6(*a*) to 6(*d*) are perspective views showing a forming process of the seam in FIG. 5. FIGS. 7(*a*) and 7(*b*) are explanatory views showing a mounted state of the seam in FIG. 5 on a sewing material, wherein FIG. 7(*a*) is a plan view from a back face side and showing a midpoint step and FIG. 7(*b*) is a plan view from the back face side and showing a final step. A plan view from a front face side is the same as FIG. 4(*a*) and is not shown.

The seam 41 is formed by two needles 11 and 21 juxtaposed in a substantially perpendicular direction to a sewing direction T similarly to the seam 1. As shown in FIG. 5, a first seam 42 is formed by one needle thread 12 out of the needle threads 12 and 22 passed through the two needles 11, 21 and a second seam 43 is formed by the other needle thread 22. The first seam 42 consists of chain seams 45 and lock seams 46 formed alternately. Similarly, the second seam 43 consists of chain seams 47 and lock seams 48 formed alternately.

As shown in FIG. 5, the needle thread 12 forming the first seam 42 and the needle thread 22 forming the second seam 43 are disposed substantially parallel. A loop 51 of the needle thread 12 forming the chain seam 45 of the first seam 42 is passed through a loop 53 of the needle thread 22 forming the opposed lock seam 48 of the second seam 43, a stitch is tightened, and a loop 52 of the needle thread 22 forming the chain seam 47 of the second seam 43 located on a downstream side in the sewing direction T is passed through the loop 51 (see FIG. 6(*c*)). The loop 52 of the needle thread 22 forming the chain seam 47 of the second seam 43 is passed through the loop 54 of the needle thread 12 forming the opposed lock seam 46 of the first seam 42, a stitch is tightened, and a loop 51 of the needle thread 12 forming the chain seam 45 of the first seam 42 located on the downstream side in the sewing direction T is passed through the loop 52 (see FIG. 6(*d*) and FIG. 7(*a*)). In this manner, the chain seams 45 and 47 and the lock seams 46 and 48 alternately switch left and right positions with each other in the seam 41. Therefore, the sewing material is retained through a certain parallel width and a force for pressing and bonding the seam to the sewing material is increased.

Figure 8:
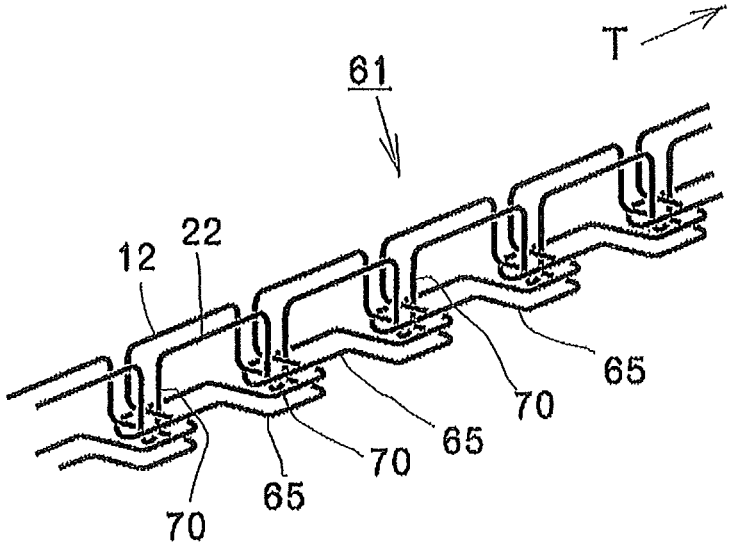
FIG. 8 is a perspective view showing another embodiment of the seam according to the invention of the present application.
Figure 9:
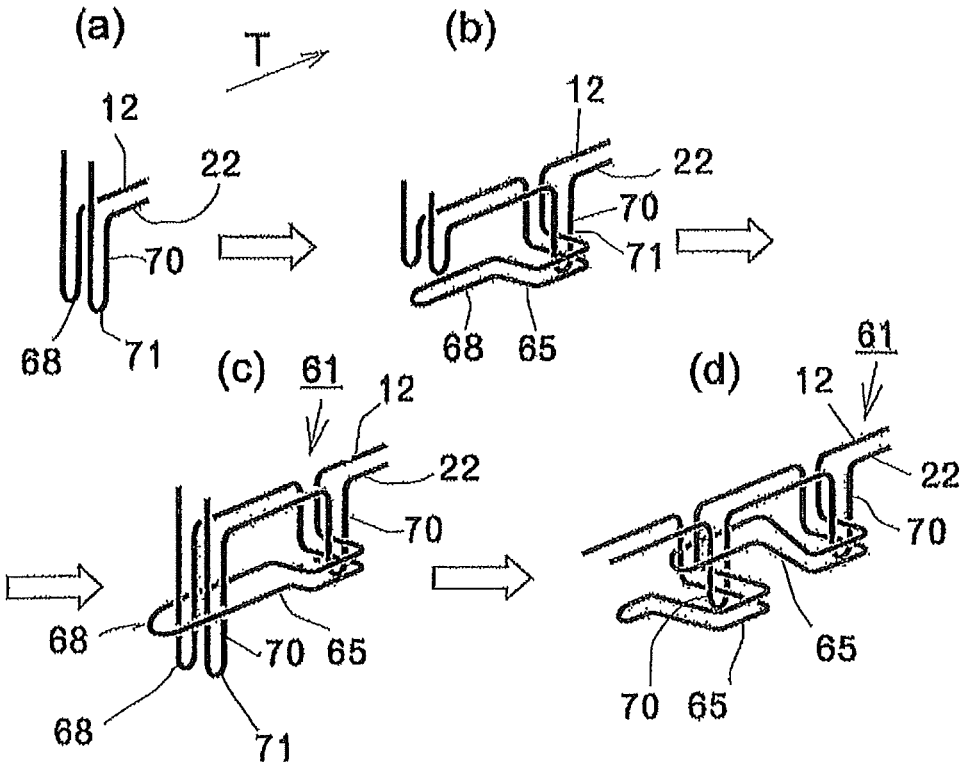
FIGS. 9(*a*) to 9(*d*) are perspective views showing a forming process of the seam in FIG. 8.
Figure 10:
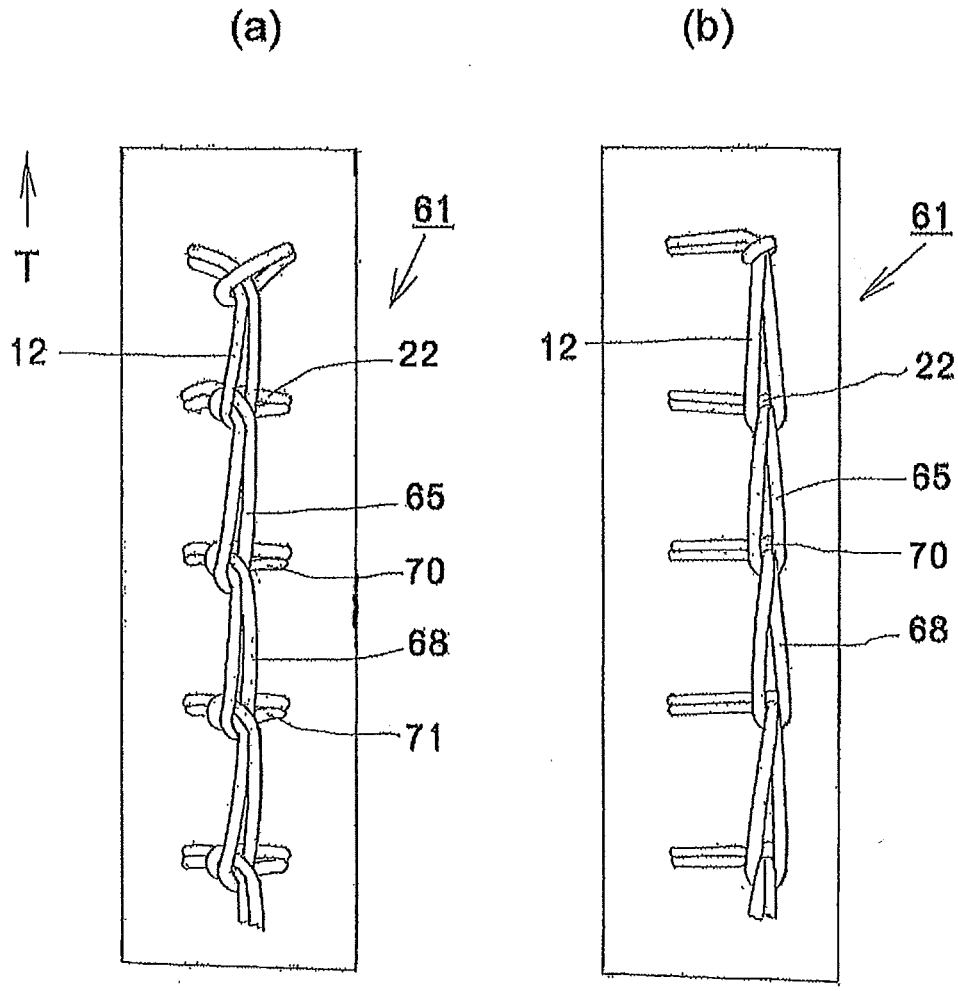
FIGS. 10(*a*) and 10(*b*) are explanatory views showing a mounted state of the seam in FIG. 8 on a sewing material.

A third embodiment of the seam according to the invention of the present application will be described based on FIGS. 8 to 10(*b*). FIG. 8 is a perspective view of the seam according to the invention of the present application. FIGS. 9(*a*) to 9(*d*) are perspective views showing a forming process of the seam in FIG. 8. FIGS. 10(*a*) and 10(*b*) are explanatory views showing a mounted state of the seam in FIG. 8 on a sewing material, wherein FIG. 10(*a*) is a plan view from a back face side and showing a midpoint step and FIG. 10 (*b*) is a plan view from the back face side and showing a final step. A plan view from a front face side is the same as FIG. 4(*a*) and is not shown.

The seam 61 is formed by two needles 11 and 21 juxtaposed in a substantially perpendicular direction to a sewing direction T. As shown in FIG. 8, the seam 61 includes chain seams 65 formed by one needle thread 12 out of the needle threads 12 and 22 passed through the two needles 11 and 21 and lock seams 70 formed by the other needle thread 22. As shown in FIG. 9(*a*), the needle thread 12 forming the chain seams 65 and the needle thread 22 forming the lock seams 70 are disposed substantially parallel. As shown in FIG. 9(*b*), in the seam 61, a loop 68 of the needle thread 12 forming the adjacent chain seams 65 is passed through a loop 71 of the needle thread 22 forming the lock seam 70, a stitch is tightened, and a loop 68 of the needle thread 12 forming the chain seam 65 and a loop 71 of the needle thread 22 forming the lock seam 70 located on a downstream side in the sewing direction T are passed through the loop 68 of the needle thread 12 forming the upstream chain seam 65 as shown in FIG. 9(*c*).

As shown in FIG. 9(*c*), the seam 61 is formed by passing the loop 68 of the chain seam 65 and the loop 71 of the lock seam 70 located on the downstream side through the loop 68 of the needle thread 12 forming the upstream chain seam 65 and is therefore different in structure from the seam 1 formed by passing only the loop 13 of the chain seam 10 located on the downstream side through the loop 13 of the upstream chain seam 10 as shown in FIG. 2(*c*). As a result, a mechanism for forming the seam 61 is simple and it is possible to narrow an interval between the parallel chain seams 65 and lock seams 70.

Figure 11:
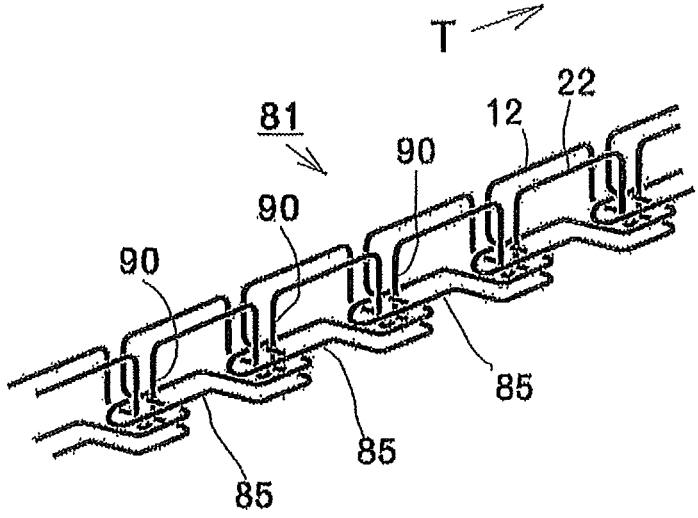
FIG. 11 is a perspective view showing another embodiment of the seam according to the invention of the present application.
Figure 12:
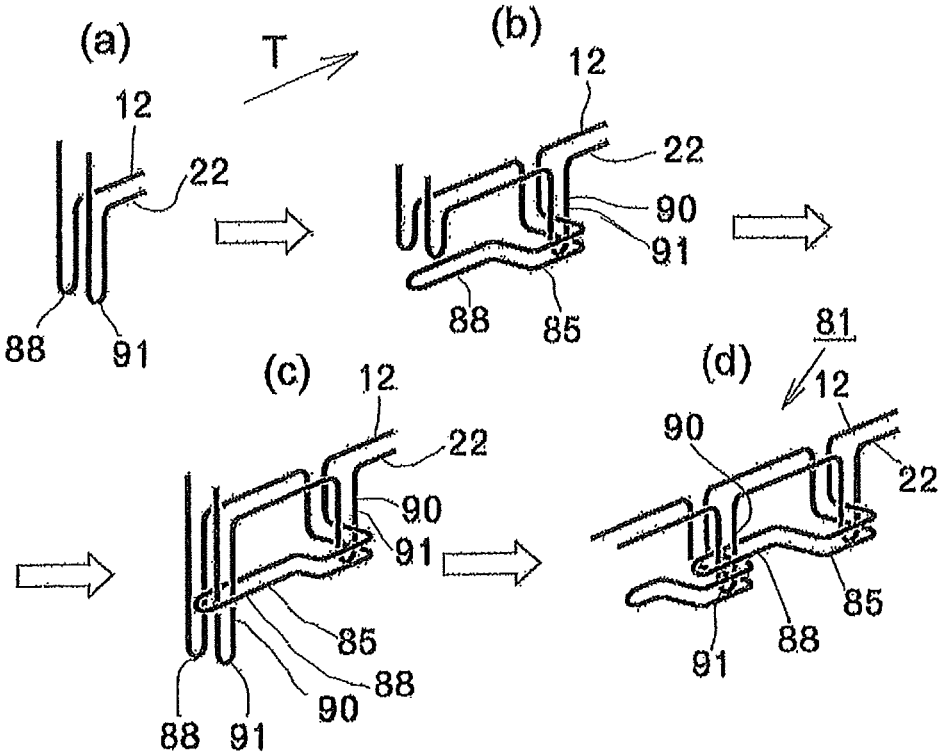
FIGS. 12(*a*) to 12(*d*) are perspective views showing a forming process of the seam in FIG. 11.
Figure 13:
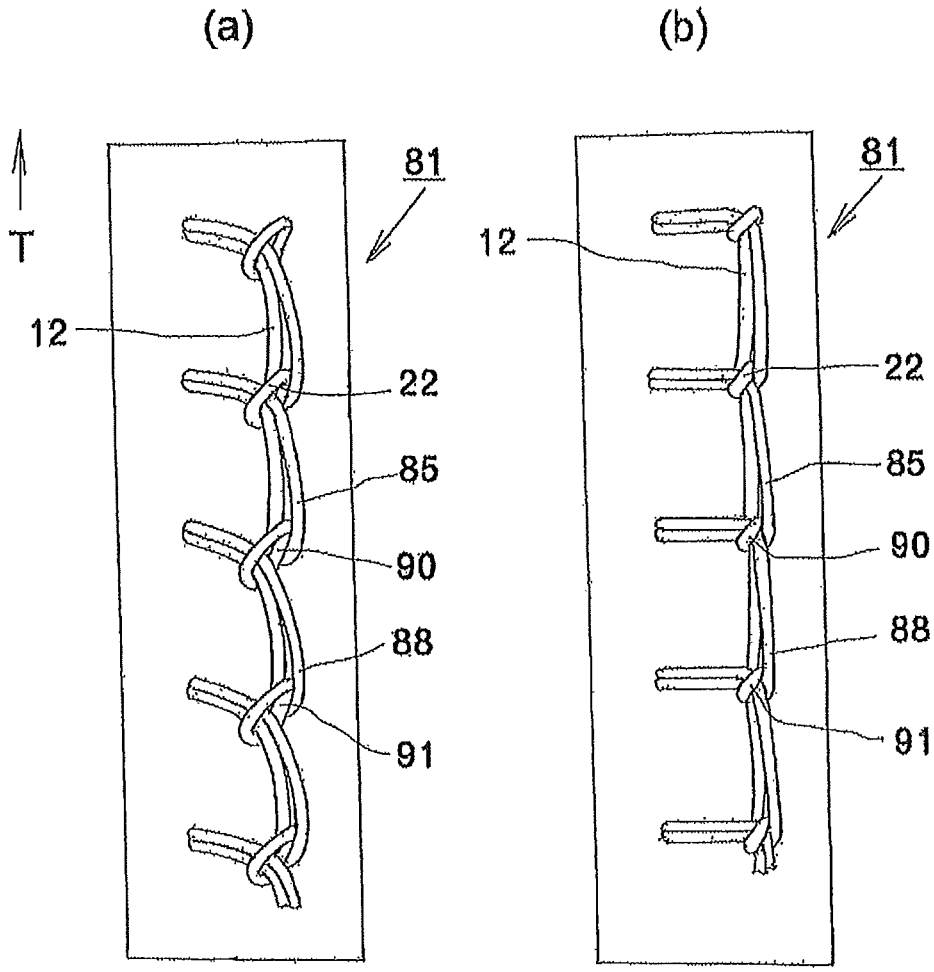
FIGS. 13(*a*) and 13(*b*) are explanatory views showing a mounted state of the seam in FIG. 11 on a sewing material.
Figure 14:
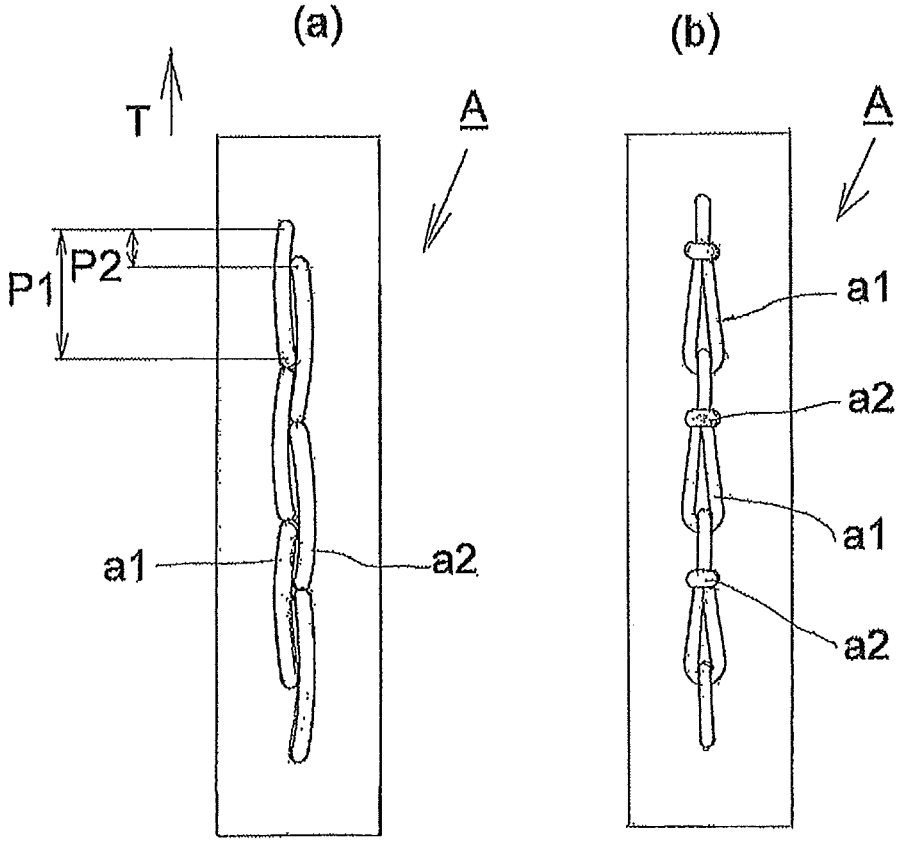
FIGS. 14(*a*) and 14(*b*) are explanatory views of a conventional seam.

A fourth embodiment of the seam according to the invention of the present application will be described based on FIGS. 11 to 13(*b*). FIG. 11 is a perspective view showing the seam according to the invention of the present application. FIGS. 12(*a*) to 12(*d*) are perspective views showing a forming process of the seam in FIG. 11. FIGS. 13(*a*) and 13(*b*) are explanatory views showing amounted state of the seam in FIG. 11 on a sewing material, wherein FIG. 13(*a*) is a plan view from a back face side and showing a midpoint step and FIG. 7(*b*) is a plan view from the back face side and showing a final step. A plan view from a front face side is the same as FIG. 4(*a*) and is not shown.

The seam 81 is formed by two needles 11 and 21 juxtaposed in a substantially perpendicular direction to a sewing direction T. As shown in FIG. 11, the seam 81 includes chain seams 85 formed by one needle thread 12 out of the needle threads 12 and 22 respectively passed through the two needles 11 and 21 and lock seams 90 formed by the other needle thread 22. As shown in FIG. 12(*a*), the needle thread 12 forming the chain seams 85 and the needle thread 22 forming the lock seams 90 are disposed substantially parallel. As shown in FIG. 12(*b*), in the seam 81, a loop 88 of the needle thread 12 forming the adjacent chain seams 85 is passed through a loop 91 of the needle thread 22 forming the lock seam 90, a stitch is tightened, and a loop 91 of the needle thread 22 forming the lock seam 90 located on a downstream side in the sewing direction T is passed through the loop 88 of the needle thread 12 forming the chain seam 85 as shown in FIG. 12(*c*).

As shown in FIG. 12(*c*), the seam 81 is formed by passing the loop 91 of the downstream lock seam 90 through the loop 88 of the chain seam 85 and is therefore different in structure from the seam 1 formed by passing the loop 13 of the downstream chain seam 10 through the loop 13 of the upstream chain seam 10 as shown in FIG. 2(*c*). However, the seam 81 has substantially the same effects as the seam 1.

As described above, the seam 1 is formed by the two needles 11 and 21 juxtaposed in the substantially perpendicular direction to the sewing direction T and includes the chain seams 10 and the lock seams 20 formed by the needle threads 12 and 22 respectively passed through the two needles 11 and 21. The loop 13 of the needle thread 12 forming the chain seam 10 is passed through the loop 23 of the needle thread 22 forming the lock seam 20, the stitch is tightened, and the loop 13 of the needle thread 12 forming the chain seam 10 located on the downstream side in the sewing direction T is passed through the upstream loop 13.

In the seam 41, the chain seams 45 and 47 and the lock seams 46 and 48 are formed alternately by the two needles 11 and 21 juxtaposed in the substantially perpendicular direction to the sewing direction T. The seam 41 consists of the first seam 42 and the second seam 43. The loop 51 of the needle thread 12 forming the chain seam 45 of the first seam 42 is passed through the opposed loop 53 of the needle thread 22 forming the opposed lock seam 48 of the second seam 43, the stitch is tightened, and the loop 52 of the needle thread 12 forming the chain seam 47 of the second seam 43 located on the downstream side in the sewing direction T is passed through the loop 51. The loop 52 of the needle thread 22 forming the chain seam 47 of the second seam 43 is passed through the loop 54 of the needle thread 12 forming the opposed lock seam 46 of the first seam 42, the stitch is tightened, and the loop 51 of the needle thread 12 forming the chain seam 45 of the first seam 42 located on the downstream side in the sewing direction T is passed through the loop 52.

The seam 61 is formed by the two needles 11 and 21 juxtaposed in the substantially perpendicular direction to the sewing direction T and includes the chain seams 65 and the lock seams 70 formed by the needle threads 12 and 22 respectively passed through the two needles 11 and 21. The loop 68 of the needle thread 12 forming the chain seam 65 is passed through the loop 71 of the needle thread 22 forming the lock seam 70, the stitch is tightened, and the loop 68 of the needle thread 12 forming the chain seam 65 and the loop 71 of the needle thread 22 forming the lock seam 70 located on the downstream side in the sewing direction is passed through the upstream loop 68.

The seam 81 is formed by the two needles 11 and 21 juxtaposed in the substantially perpendicular direction to the sewing direction T and includes the chain seams 85 and the lock seams 90 formed by the needle threads 12 and 22 respectively passed through the two needles 11 and 21. The loop 88 of the needle thread 12 forming the chain seam 85 is passed through the loop 91 of the needle thread 22 forming the lock seam 90, the stitch is tightened, and the loop 91 of the needle thread 22 forming the lock seam 90 located on the downstream side in the sewing direction T is passed through the upstream loop 88.

Each of the seams 1, 41, 61, and 81 are formed by forming the chain seams and the lock seams by the two needles 11 and 21 juxtaposed in the substantially perpendicular direction to the sewing direction T. Therefore, unlike the conventional seam, each of the seams can be formed without the trouble of setting the positional relationship between the needle for forming the chain seams and the needle for forming the lock seams in consideration of the feeding pitch width of the needle for forming the chain seams and the interval between the needle for forming the chain seams and the needle for forming the lock seams.

In each of the seams 1, 41, 61, and 81, the chain seams and the lock seams are disposed with the predetermined interval therebetween and the loop of the needle thread forming the lock seam does not immediately pull the loop of the needle thread forming the chain seam to the front face side (upward) of the sewing material but pulls and tightens the loop to the front face side (upward) of the sewing material after pulling the loop aside (toward the lock seam) along the back face side of the sewing material. Therefore, the tightening force and the resisting force are increased, so that the slackening and raveling can be prevented drastically, thereby reliably performing tightening of the stitch.

Industrial Applicability

The seam according to the invention of the present application can be utilized for fabric goods such as clothes and leather goods such as bags.

EXPLANATION OF REFERENCE NUMERALS

T Sewing direction
1 Seam
10 Chain seam
11 Needle
12 Needle thread
13 Loop
15 Knot portion
20 Lock seam
21 Needle
22 Needle thread
23 Loop
25 Tightening portion
30 Seam forming device
31 First looper
32 Loop spreader
33 Second looper
41 Seam
42 First seam
43 Second seam
45 Chain seam
46 Lock seam
47 Chain seam
48 Lock seam
51 Loop
52 Loop
53 Loop
54 Loop
61 Seam
65 Chain seam
66 Knot portion
68 Loop
70 Lock seam
71 Loop
81 Seam
85 Chain seam
88 Loop
90 Lock seam
91 Loop

The invention claimed is:

1. A seam formed by two needles juxtaposed in a substantially perpendicular direction to a sewing direction, wherein the seam includes chain seams and lock seams formed by needle threads respectively passed through the two needles, a loop of the needle thread forming the chain seam is passed through a loop of the needle thread forming the lock seam, a stitch is tightened, and a loop of the needle thread forming the chain seam located on a downstream side in the sewing direction is passed through the loop of the needle thread forming the upstream chain seam.

2. A seam formed by two needles juxtaposed in a substantially perpendicular direction to a sewing direction, wherein the seam includes chain seams and lock seams formed by needle threads respectively passed through the two needles, a loop of the needle thread forming the chain seam is passed through a loop of the needle thread forming the lock seam, a stitch is tightened, and a loop of the needle thread forming the lock seam located on a downstream side in the sewing direction is passed through the loop of the needle thread forming the upstream chain seam.

3. A seam formed by two needles juxtaposed in a substantially perpendicular direction to a sewing direction, wherein the seam includes chain seams and lock seams formed by needle threads respectively passed through the two needles, a loop of the needle thread forming the chain seam is passed through a loop of the needle thread forming the lock seam, a stitch is tightened, and a loop of the needle thread forming the chain seam and a loop of the needle thread forming the lock seam located on a downstream side in the sewing direction are passed through the loop of the needle thread forming the upstream chain seam.

4. A seam formed by alternately forming chain seams and lock seams by two needles juxtaposed in a substantially perpendicular direction to a sewing direction, wherein the seam includes a first seam and a second seam, a loop of the needle thread forming the chain seam of the first seam is passed through a loop of the needle thread forming the opposed lock seam of the second seam, a stitch is tightened, a loop of the needle thread forming the chain seam of the second seam located on a downstream side in the sewing direction is passed through the loop of the needle thread forming the upstream chain seam of the first seam, a loop of the needle thread forming the chain seam of the second seam is passed through a loop of the needle thread forming the opposed lock seam of the first seam, a stitch is tightened, and a loop of the needle thread forming the chain seam of the first seam located on a downstream side in the sewing direction is passed through the loop of the needle thread forming the upstream chain seam of the second seam.

5. A seam forming device comprising:

two needles which are juxtaposed in a substantially perpendicular direction to a sewing direction and to which needle threads for forming chain seams and lock seams are fed;

an upper drive means for reciprocating the two needles in a vertical direction;

a first looper for passing a loop of the needle thread of one of the needles formed on a back face side of a sewing material through a loop of the needle thread of the other needle in synchronization with vertical movements of the two needles;

a loop spreader for retaining the loop of the needle thread of the one needle formed by the first looper until the needle thread of the one needle of the next or later stitch is positioned in the loop of the needle thread of the one needle of the earlier stitch;

a second looper for passing the loop of the needle thread of the one needle of the next or later stitch through the loop of the one needle thread retained by the loop spreader; and a lower drive means for causing the first and second loopers and the loop spreader to operate in synchronization with the vertical movements of the two needles, wherein the device forms a seam formed by tightening the chain seam by the lock seam.

6. A seam forming method for sewing by forming chain seams and lock seams with needle threads of two needles juxtaposed in a substantially perpendicular direction to a sewing direction, the method comprising:

a first step of moving down the two needles by a drive means to protrude the needle thread of one needle and the needle thread of the other needle to a back face side of a sewing material;

a second step of moving up the two needles by the drive means to form a loop of the needle thread of the one needle and a loop of the needle thread of the other needle on the back face side of the sewing material and passing the loop of the needle thread of the one needle formed on the back face side of the sewing material through the loop of the needle thread of the other needle by a first looper protruding in synchronization with the upward movements of the two needles;

a third step of retaining the loop of the needle thread of the one needle, which is retained by the first looper during the upward movements of the two needles, on a loop spreader protruding in synchronization with the upward movements of the two needles and then for returning the first looper to an original position to separate the first looper from the one needle thread; and a fourth step of spreading the loop of the one needle thread, which is retained on the loop spreader, by a second looper protruding in synchronization with the first looper, passing the one needle out of the two lowering needles through the spread loop of the one needle thread, and returning the second looper and the loop spreader to original positions to separate the second looper and the loop spreader from the one needle thread.

* * * * *